US005242138A

United States Patent [19]

Kornberg

[11] Patent Number: 5,242,138

[45] Date of Patent: Sep. 7, 1993

[54] ARM REST FOR A WHEELCHAIR

[76] Inventor: Gary Kornberg, 19 Kathleen Dr. East, Syosset, N.Y. 11791

[21] Appl. No.: 821,078

[22] Filed: Jan. 16, 1992

[51] Int. Cl.[5] ..... B68G 5/00

[52] U.S. Cl. ..... 248/118; 248/297.3; 280/304.1; 297/411.36; 297/411.38

[58] Field of Search ..... 248/118, 118.3, 354.5, 248/292.3, 295.1, 289.1, 283; 280/304.1; 297/411, 417

[56] References Cited

U.S. PATENT DOCUMENTS

| | | | |
|---|---|---|---|
| 1,399,744 | 12/1921 | Brophy | 297/417 |
| 2,172,178 | 9/1939 | Rosenberg | 248/118 |
| 3,140,119 | 7/1964 | Offner | 297/417 |
| 4,489,980 | 12/1984 | Friedrich | 297/417 X |
| 4,555,121 | 11/1985 | Lockard et al. | 280/304.1 X |
| 4,813,693 | 3/1989 | Lockard et al. | 280/304.1 X |
| 5,050,831 | 9/1991 | Joyal | 248/354.5 X |

*Primary Examiner*—Ramon O. Ramirez
*Attorney, Agent, or Firm*—Rodman & Rodman

[57] ABSTRACT

The arm rest for a wheelchair includes a pair of upright members pivotable with respect to a cross piece assembly. The cross piece assembly includes an arm rest surface or cushion asymmetrically mounted to a cross member such that one end of the arm rest surface projects from one end of the cross member whereas an opposite end of the arm rest surface is retracted from an opposite end of the cross member. The arm rest is detachably received in an arm rest holder of a wheelchair and can be positioned with a front end extension. The arm rest can also be detached from the wheelchair and reversed in position such that the front end projecting portion of the arm rest surface is directed toward the rear of the wheelchair, to provide extended arm rest support at the rear, as when the user is in a reclined position. The arm rest is also height adjustable, angle adjustable, and removable. Adjustment and removal of the arm rest from the wheelchair is easily accomplished by removing a height adjustment pin from openings in the arm rest holder and the upright members of the arm rest. The distance between the upright members is also variable.

21 Claims, 3 Drawing Sheets 10
14
60
16
60
18
20
16
12
28
22
18
20
24

ARM REST FOR A WHEELCHAIR

BACKGROUND OF THE INVENTION

This invention is directed to wheelchairs and more particularly to an arm rest for a wheelchair that can be tilted and reversibly mounted to provide extended support for a user's arms at the front of the chair or at the rear of the chair.

Since wheelchair users often spend numerous hours each day in the chair, it is occasionally necessary that their seating position be modified to improve comfort. Positional modification can be accomplished, for example, by adjusting a back rest of the wheelchair from an upright position to a reclined position. More specifically, the back rest can be reclined at a predetermined angle such as 30° from the normal upright position.

When the back rest of a wheelchair is thus reclined, an arm space is generally present between the back rest and the back end of the arm rest. It is thus desirable to provide arm support at the arm space to prevent an occupant's arms from slipping into the arm space in an uncomfortable position and/or being injured by the wheels when the wheelchair is moved.

Arm support at the arm space is often provided by stuffing pillows or other filler material into the space. Comfort of a wheelchair occupant can also be enhanced in some circumstances by supporting the user's arms at a selected angle. Angular support of the user's arms is generally provided with auxiliary pillows or padding which are cumbersome to use since they often need frequent adjustment, are bulky, and must be cleaned periodically.

In some instances, the arm rests of a wheelchair will interfere with a desk, table or workstation that a wheelchair user wishes to access. The wheelchair occupant may thus be forced to assume a position of imbalance or discomfort in order to function at the desk, table or workstation.

U.S. Pat. Nos. 3,140,119 and 3,950,026 show wheelchairs with arm rests that can be slidably moved in a forward or rearward position. However the arm rests are not tilt adjustable and require special mounting arrangements.

It is thus desirable to provide an arm rest for a wheelchair with extended arm support when needed at the front or rear, and which arm rest can be abbreviated at a front end to facilitate positioning of the wheelchair adjacent a desk, table or workstation. It is also desirable to provide an arm rest that can be height adjusted and angle adjusted to support the user's arms at selected elevations and/or angles.

OBJECTS AND SUMMARY OF THE INVENTION

Among the several objects of the invention may be noted the provision of a novel arm rest for a wheelchair, a novel arm rest for a wheelchair that can be selectively positioned to provide a forward extension at the front of the arm rest or a rearward extension at the rear of the arm rest, a novel arm rest for a wheelchair which can be height adjusted, a novel arm rest for a wheelchair which can be adjusted to selected angles to incline forwardly or rearwardly with respect to the horizontal, a novel arm rest for a wheelchair that can be reversibly positioned on the wheelchair to provide a forward extension or a rearward extension, and a novel arm rest that can be removed when desired.

Other objects and features of the invention will be in part apparent and in part pointed out hereinafter.

In accordance with one embodiment of the invention, the arm rest for a wheelchair includes a pair of spaced upright members pivotable with respect to an elongated cross piece assembly. The cross piece assembly includes a cross member and an arm rest support surface joined to the cross member. The distance between the upright members can be adjusted to permit reception of the upright members in wheelchairs with differently spaced arm rest holding means.

Preferably one of the upright members is pivoted to an end of the cross member and the other upright member is pivoted a short distance from the opposite end of the cross member. The distance between the upright members can be adjusted to permit reception of the upright members in wheelchairs with differently spaced arm rest holding means.

The arm rest surface or cushion is asymmetrically joined to the cross member such that one end of the arm rest surface projects from one end of the cross member whereas the opposite end of the arm rest surface is retracted from the opposite end of the cross member.

The upright support members are detachably joined to corresponding holding means on a wheelchair. Detachable securance is accomplished, for example, by providing transverse openings in the arm rest holder of the wheelchair and corresponding openings in the upright members of the arm rest. An adjustment pin engages aligned transverse openings in the arm rest support and the upright members to detachably lock the position of the arm rest in the arm rest holder.

A plurality of transverse openings in the upright members permit height adjustment and angle adjustment of the arm rest. Angle adjustment is accomplished by telescopically elevating one of the upright members to a different height than the other upright member.

Each of the upright members is of the same cross section to permit reverse positioning of the upright members in the arm rest holder. Thus the arm rest with a projecting front end portion and an abbreviated rear end portion can be reversed such that the arm rest has an abbreviated front end portion and a projecting rear end portion.

Under this arrangement the arm rest can be positioned to provide desirable front end arm support when the occupant is in an upright position or rear end arm rest support when the occupant is in a reclined position. Angle adjustments of the arm rest help enhance the comfort and stability of the occupant.

The invention accordingly comprises the constructions hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figure 1:
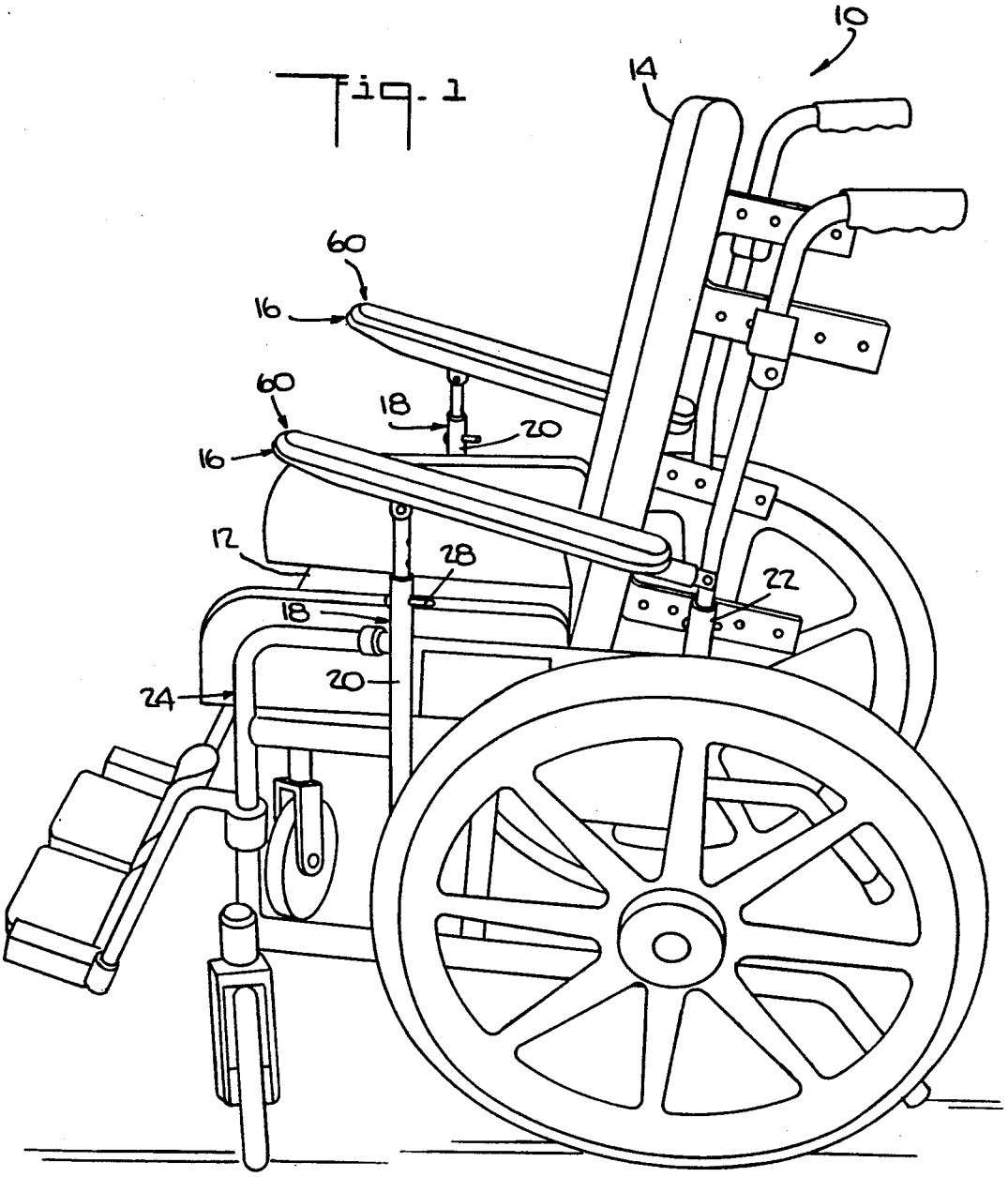
FIG. 1 is a simplified perspective view of an arm rest incorporating one embodiment of the invention assembled to a wheelchair.

A wheelchair incorporating one embodiment of the invention is generally indicated by the reference number 10 in FIG. 1.

The wheelchair 10 includes a seat 12, a back rest or support 14 which can be reclined from the seat 12 in any suitable known manner. A pair of symmetrical arm rests 16 are provided at opposite sides of the seat 12 and are held in place by symmetrical arm rest holders or supports 18, also provided at opposite sides of the seat 12.

Since the arm rests 16 and the arm rest supports 18 at each side of the wheelchair are similar, only one of each will be described.

The arm rest support 18 includes a forward support tube 20 and a rear support tube 22 joined to a frame 24 of the wheelchair. The forward tube 20 includes a transverse opening 26 (FIG. 2) which receives a height adjustment pin 28.

The rear support tube 22 is of identical cross section with that of the forward support tube 20. The rear support tube 22 includes a transverse opening 30 identical to the opening 26. The opening 30 also receives a height adjustment pin 28.

Figure 2:
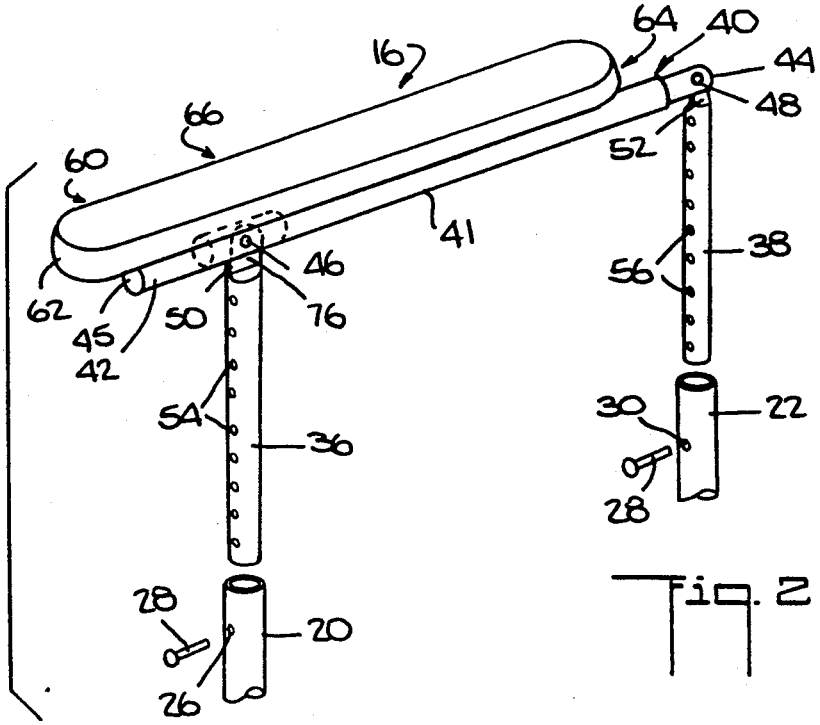
FIG. 2 is a simplified perspective view thereof, separated from the wheelchair.
Figure 3:
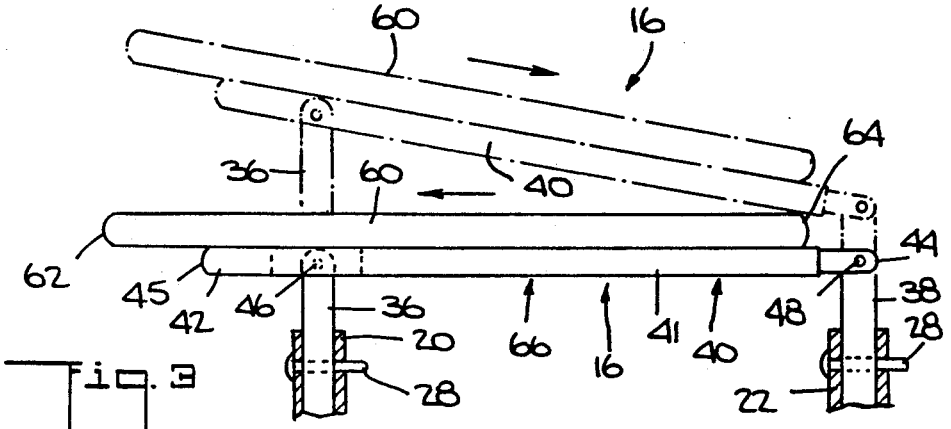
FIG. 3 is a simplified elevation thereof with an inclined position being shown in dotted line.
Figure 4:
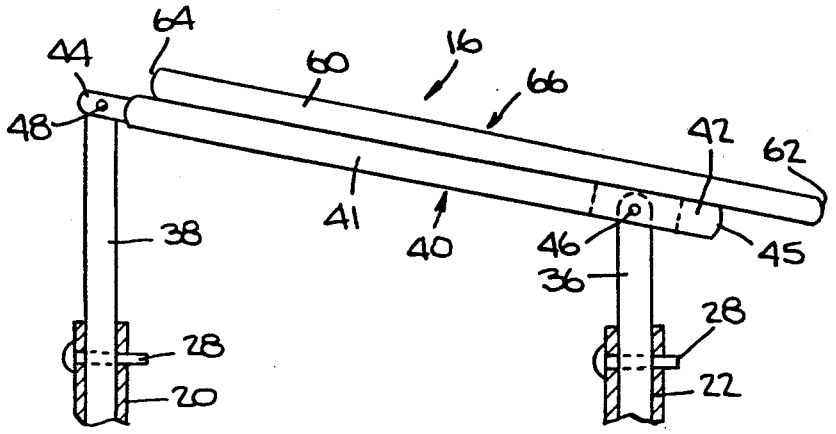
FIG. 4 is a simplified elevation view thereof in a reversed inclined position.

Referring particularly to FIGS. 2, 3 and 4, the arm rest 16 includes a pair of substantially identical spaced upright members 36 and 38 pivotable with respect to a tubular cross member 40 having a wall portion 41. The cross member 40 has an end portion 42 covered with a cap member 45.

Figure 5:
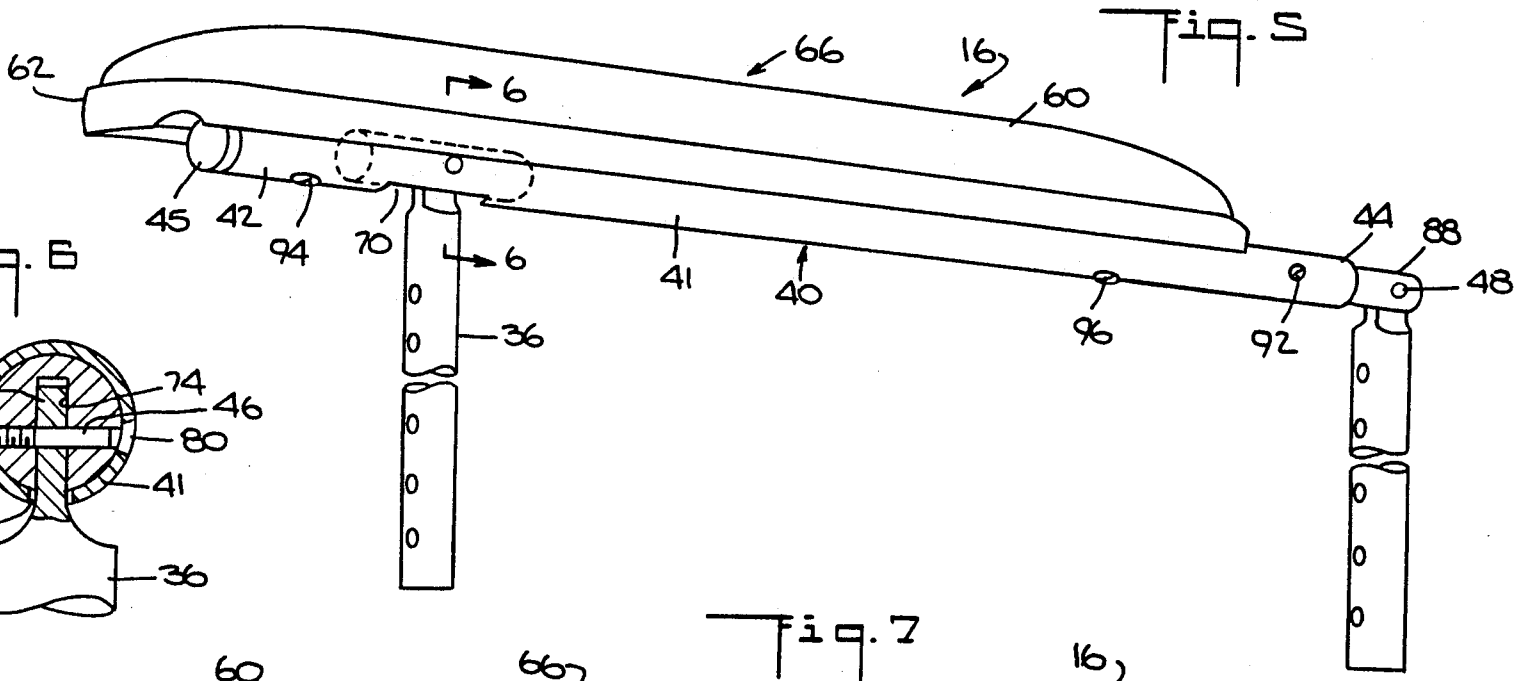
FIG. 5 is a detailed perspective view thereof.
Figure 6:
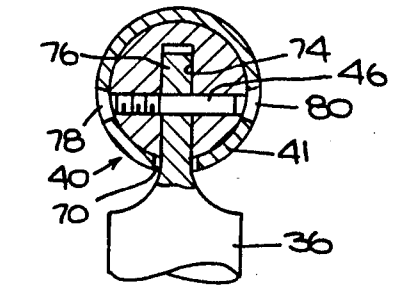
FIG. 6 is a sectional view taken on the line 6—6 of FIG. 5.
Figure 7:
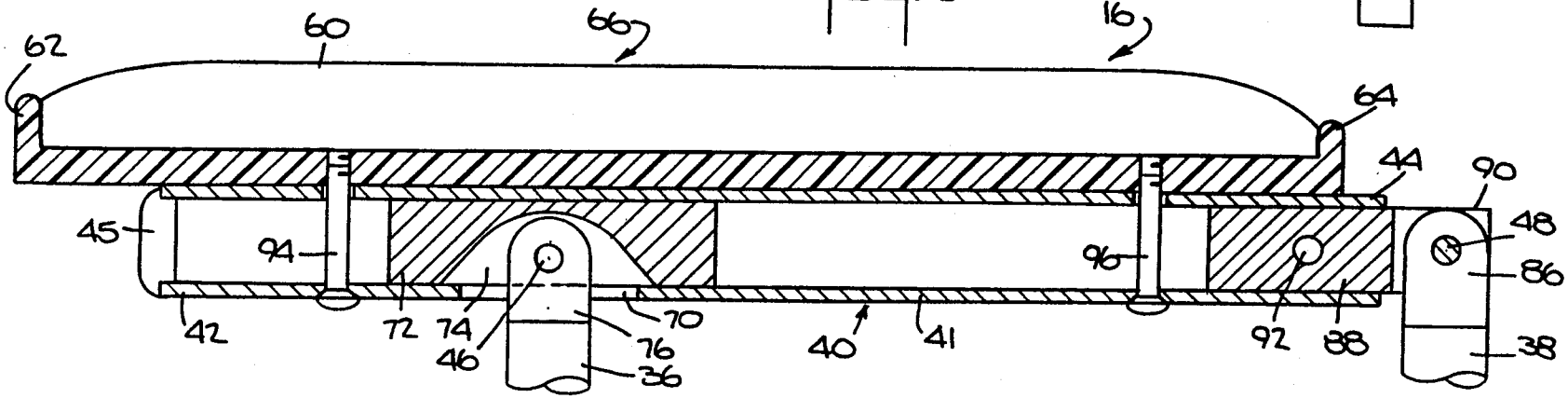
FIG. 7 is a side view of FIG. 5, partly shown in section.

As most clearly shown in FIGS. 5–7, the cross member 40 includes an axial slot 70 formed in the wall portion 41. A slider member 72 is slidably disposed in the cross member 40 and includes a channel-like recess 74 (FIGS. 6 and 7).

The upright member 36, which is preferably formed of solid cylindrical rod, has a flattened end portion 76 (FIG. 6) that is receivable in the channel recess 74 of the slide 72. A pivot pin 46 pivotally joins the upright member 36 to the slider member 72. The pin 46 is of a length that does not exceed the diameter of the slider member 72. Thus the slider member 72, while pivotally joined to the upright member 36, is slidable relative to the cross member 40.

Access openings 78 and 80 formed in cross member wall 41 permit access to and installation of the pivot pin 46 in the slider member 72. Under this arrangement, the upright member 36 is pivotable with respect to the cross member 40 and is distance adjustable with respect to the upright member 38. The upright member 36 can thus be located selected predetermined distances from the end portion 42.

The upright member 38, which is also preferably formed of solid cylindrical rod, has a flattened end portion 86 (FIG. 7) similar to the flattened end portion 76 of the upright member 36. The flattened end portion 76 is pivoted via a pivot pin 48 to an extension piece 88 of the cross member 40 at a bifurcated end 90 of the extension piece 88. The extension piece 88 is fixed to an end portion 44 of the cross member 40 by a fastener 92.

A plurality of transverse openings 54 are provided along the length of the upright member 36 and are sized to accommodate the height adjustment pin 28. Similarly a plurality of transverse openings 56 identical in size to the transverse openings 54 are provided along the length of the upright member 38. The transverse openings 56 accommodate a corresponding height adjustment pin 28.

The arm rest 16 further includes an arm rest cushion or support 60 that is asymmetrically mounted to the cross member 40 in any suitable known manner as by use of screws 94, 96 (FIG. 7) that extend transversely through the cross member 40 into the cushion or support 60. The arm rest cushion 60 includes opposite end portions 62 and 64. Thus the asymmetric mounting of the arm rest cushion 60 to the cross member 40 results in an extension of the end portion 62 beyond the end portion 42 of the cross member 40, whereas the end portion 64 of the cushion 60 is retracted a predetermined amount from the corresponding end portion 44 of the cross member 40.

The arm rest cushion 60 and the cross member 40 constitute a cross piece assembly 66.

In using the arm rest 16, the upright members 36 and 38 are accommodated in the respective forward and rear support tubes 20 and 22 of the wheelchair frame 24. The slidability of the slide member 72 enables the upright members 36 and 38 to be positioned at selected distances from each other to fit support tubes 20 and 22 of different spacing.

Depending upon the elevation desired for the arm rest cushion 60, the height adjustment pins 28 are coengaged with the opening 26 and a selected opening 54 of the upright member 36. Similarly, the height adjustment pin 28 is coengaged with the opening 30 in the rear tube 22 and a selected opening 56 in the upright member 38.

Under this arrangement the projecting end 62 of the arm rest cushion 60 extends in a forward direction as shown in FIG. 1 to provide enhanced front end arm support. Such enhanced front end arm support is usually needed when an occupant is in an upright position in the wheelchair. If inclination of the arm rest 16 is desired, the upright member 36 can be elevated with respect to the upright member 38 such as shown in dotted lines in FIG. 3. The height adjustment pin 28 engaged with the appropriate opening 54 in the upright member 36 detachably locks the cross piece assembly 66 in the desired inclination. Arm rest angle adjustments in the range of 35° can be easily obtained.

If arm rest inclination in the opposite direction is sought, as shown in FIG. 4, the upright member 38 can be elevated with respect to the upright member 36. The height adjustment pin 28 is aligned with the transverse opening 56 in the upright member 38 to detachably lock the cross piece assembly 66 in another possible inclination.

The adjustment pins 28 are easily detached from the support tubes 20, 22 and the upright members 36 and 38 to permit easy adjustment of the inclination or elevation of the arm rest cushion 60.

If extended arm support is needed at the rear of the wheelchair, as for example, where the back rest 14 is reclined (not shown) the arm rest 16 is detached from the forward and rear support tubes 20 and 22 and reversed from the position shown in FIG. 3 to the position shown in FIG. 4.

Position reversal is simply accomplished by removing the height adjustment pin 28 from each of the upright members 36 and 38, and telescopically withdrawing the arm rest 16 from the arm rest support tubes 20 and 22. The arm rest 16 is reinstalled by interchanging the upright members 36 and 38 in the respective support tubes 20 and 22.

Once the arm rest cushion 60 is positioned as shown in FIG. 4, the projection of the end 62 of the arm rest cushion 60 in a rearward direction permits the back rest 14 to be reclined a predetermined amount without causing an arm space to exist between the arm rest 16 and the back rest 14. Thus arm support can be provided all the way to the back rest 14 even when the back rest 14 is in a reclined position. The likelihood that an occupant's arms will slip below the arm rest is substantially eliminated. Further, since the front end of the arm rest 16 is abbreviated as shown in FIG. 4, the wheelchair 10 can be located close to a table, desk or workstation.

In instances where it is desirable to remove the arm rest 16 entirely from the wheelchair 10, as where it is necessary to position the wheelchair underneath a table or desk and avoid interference with the arm rest, it is a simple matter to remove the arm rests 16 in the manner previously described.

Elevation of the arm rest 16 to a selected height may be desired if it becomes necessary to elevate the occupant of the wheelchair. Angular positioning of the arm rest 16 may also be beneficial to coordinate with the position of the occupant in the wheelchair 10.

The arm rest 16 thus provides a versatile support arrangement for a wheelchair that is adapted to facilitate comfortable and stable positioning of the user in a variety of positions, be they upright, reclined or elevated.

Some advantages of the invention evident from the foregoing description include an arm rest for a wheelchair that is height adjustable, angle adjustable and can be positioned with a front end projecting arm rest, a rear end projecting arm rest, and a front end retracted arm rest or a rear end retracted arm rest. The adjustable spacing of the upright members enables the arm rest to be retrofitted to most standard wheelchairs with removable arms.

A further advantage is that the height adjustments, angle adjustments and the positioning of the arm rests with a frontwardly projecting end or rearwardly projecting end is simply and easily accomplished by removing a height adjustment pin from the arm rest and reinserting the pin to lock the arm rest in its new position.

Tilted wheelchair arms increase proprioception from the upper extremities to the trunk for enhanced spinal extension and more erect posture of the wheelchair occupant. The adjustable arm rest also provides a place for attachment of any standard wheelchair lapboard, tray or table, to provide the wheelchair occupant various work station heights for writing, reading, eating and other non-verbal communication activities.

Thus when a wheelchair seat is inclined upwardly at the front to inhibit extension thrust reaction, or inclined upwardly at the rear, or reclined for a desired orientation in space, the adjustability of the wheelchair arms provides comfort enhancement, security enhancement and desired clearance for the knees, especially when a wheelchair table is located on the arm rests.

In view of the above, it will be seen that the several objects of the invention are achieved and other advantageous results attained.

As various changes can be made in the above constructions without departing from the scope of the invention, it is intended that all matter contained in the above description or shown in the accompanying drawings shall be interpreted as illustrative and not in a limiting sense.

What is claimed is:

1. An arm rest for a wheelchair having an arm rest holder comprising, a) an elongated cross member of a first predetermined length and having opposite ends, b) a pair of upright members, each said upright member being pivotable with respect to said cross member and spaced a selected distance from each other, said upright members being adapted to telescopically engage with a wheelchair arm rest holder for non-pivotable connection to said arm rest holder and said upright members are of identical cross section to permit reversible interchange of said upright members in said arm rest holder, and c) an elongated arm rest surface of a second predetermined length and having opposite ends, said arm rest surface being asymmetrically joined to said cross member such that one end of said arm rest surface projects a greater amount beyond said cross member than the other end of said arm rest surface, whereby said upright members are telescopically positionable in said arm rest holder in interchangeable reverse orientations such that in a first interchangeable orientation said one end of said arm rest surface is in a front position and the other end of said arm rest surface is in a rear position, and in a second interchangeable reverse orientation said one end of said arm rest surface is in said rear position and said other end of said arm rest surface is in said front position.

2. The arm rest as claimed in claim 1 wherein said upright members have height adjustment means including a removable latching member for engagement with a wheelchair arm rest holder.

3. The arm rest as claimed in claim 1 wherein said upright members include means for adjusting the telescopic engagement of said upright members with said arm rest holder.

4. The arm rest as claimed in claim 3 wherein said adjusting means include a removable adjustment member engagable in each of said upright members for fixing the relative position of each of said upright members and the arm rest holder.

5. The arm rest as claimed in claim 4 wherein said upright members include a plurality of transverse openings longitudinally spaced along the length of said upright member.

6. The arm rest as claimed in claim 1 wherein one of said upright members is pivoted with respect to said cross member intermediate opposite ends of said cross member.

7. The arm rest as claimed in claim 6 wherein said one of said upright members is pivoted with respect to said cross member a selected distance from a second end of said cross member.

8. The arm rest as claimed in claim 6 wherein the other of said upright members is pivoted to said cross member at a first end of said cross member.

9. The arm rest as claimed in claim 8 wherein said arm rest surface does not extend to said first end of said cross member.

10. The arm rest as claimed in claim 7 wherein said arm rest surface extends beyond said second end of said cross member.

11. An arm rest device for a wheelchair comprising, a) an elongated arm rest member having an arm rest surface with opposite ends, b) a pair of upright members spaced a selected distance from each other and pivotally joined to said arm rest member, each said upright member having connection means to permit non-pivotable connection to said wheelchair and height adjustment means for elevating each end of said arm rest surface to respective first and second predetermined heights with respect to a seat of said wheelchair such that said arm rest surface is height adjustable and tilt adjustable to selected angles with respect to said wheelchair seat.

12. An arm rest for a wheelchair having an arm rest holder comprising, a) an elongated cross member of a first predetermined length and having opposite ends, b) a pair of upright members, each said upright member being pivotable with respect to said cross member and spaced a selected distance from each other, c) means for changing the spacing between the upright members, and d) an elongated arm rest surface of a second predetermined length and having opposite ends, said arm rest surface being asymmetrically joined to said cross member such that one end of said arm rest surface projects a greater amount beyond said cross member than the other end of said arm rest surface.

13. The arm rest as claimed in claim 12 wherein said means for changing the spacing include a slide member, slidably mounted to said cross member, and wherein one of said upright members is pivoted to said slide ember.

14. An arm rest for a wheelchair having an arm rest holder comprising, a) an elongated cross piece assembly, b) a pair of upright members pivoted with respect to said cross piece assembly and spaced a selected distance from each other, said upright members being of identical cross section to permit reversible interchange of said upright members in said arm rest holder, said upright members having connection means to permit non-pivotable connection to said arm rest holder, and c) said cross piece assembly including an elongated arm rest surface having opposite ends, one end of said arm rest surface being spaced a first predetermined distance from said one upright member and the opposite end of said arm rest surface being spaced a second predetermined distance from the other said upright member, said first predetermined distance being greater than said second predetermined distance such that said arm rest surface extends a greater amount beyond said one upright member than the other said upright member, whereby said upright members are positionable in said arm rest holder in interchangeable reverse orientations such that in a first interchangeable orientation said one end of said arm rest surface is in a front position and the other end of said arm rest surface is in a rear position, and in a second interchangeable reverse orientation said one end of said arm rest surface is in said rear position and said other end of said arm rest surface is in said front position.

15. The arm rest as claimed in claim 14 wherein said first end portion is protracted beyond said first upright member and away from said second upright member.

16. The arm rest as claimed in claim 14 wherein said second end portion is retracted from said second upright member toward said first upright member.

17. The arm rest as claimed in claim 14 wherein said first upright member is pivoted with respect to said cross piece assembly intermediate opposite ends of said arm rest surface.

18. The arm rest as claimed in claim 14 wherein said second upright member is pivoted with respect to said cross piece assembly beyond the opposite end of said arm rest surface, 19. The arm rest as claimed in claim 14 wherein said cross piece assembly includes a cross member and said arm rest is joined to said cross member.

20. The arm rest as claimed in claim 14 wherein each of said upright members has height adjustment means for elevating each end of said arm rest surface to respective first and second predetermined heights with respect to said arm rest holder such that said arm rest surface is tilt adjustable to selected angles with respect to said arm rest holder.

21. The arm rest as claimed in claim 20 wherein said height adjustment means include a plurality of longitudinally spaced transverse openings in each of said upright members and a locking member for each said upright member adapted to fit into said openings to lock the position of each said upright member in a height that corresponds to a selected opening.

* * * * *